United States Patent [19]

Gianni et al.

[11] 4,284,133

[45] Aug. 18, 1981

[54] CONCENTRIC TUBE HEAT EXCHANGE ASSEMBLY WITH IMPROVED INTERNAL FIN STRUCTURE

[75] Inventors: Sebastian J. Gianni, Wethersfield, Conn.; William M. Seeley, Brewster, N.Y.

[73] Assignee: Dunham-Bush, Inc., West Hartford, Conn.

[21] Appl. No.: 77,067

[22] Filed: Sep. 19, 1979

[51] Int. Cl.[3] ..... F28F 13/00; F28D 7/10

[52] U.S. Cl. ..... 165/133; 62/527; 165/156

[58] Field of Search ..... 62/515, 527; 165/DIG. 11, 154, 156, 133, 105

[56] References Cited

U.S. PATENT DOCUMENTS

| | | | |
|---|---|---|---|
| 2,428,993 | 10/1947 | Reischelderfer | 165/156 |
| 2,503,595 | 4/1950 | Preston | 165/156 |
| 3,009,045 | 11/1961 | Porter | 165/185 |
| 3,197,975 | 8/1965 | Boling | 165/154 |
| 3,235,003 | 2/1966 | Smith | 165/154 |
| 4,163,474 | 8/1979 | MacDonald et al. | 138/38 |
| 4,223,723 | 9/1980 | Hilal | 165/105 X |

*Primary Examiner*—Sheldon J. Richter

*Attorney, Agent, or Firm*—Sughrue, Mion, Zinn, Macpeak and Seas

[57] ABSTRACT

A heat exchanger formed by concentric, spaced tubes defining a substantially annular chamber therebetween. There is an internal metallic fin comprising a strip of corrugated sheet metal extending spirally within the annular chamber with the adjacent turns of the spirally formed strip being spaced from each other to provide a spiral passageway between the side edges of adjacent turns. The metallic fin corrugated sheet metal strip bears a plurality of small apertures to significantly improve the boiling heat transfer coefficient.

4 Claims, 7 Drawing Figures

FIG 1
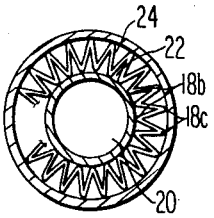
FIG 2
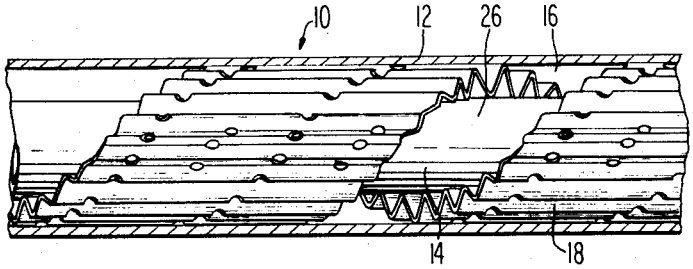
FIG 3
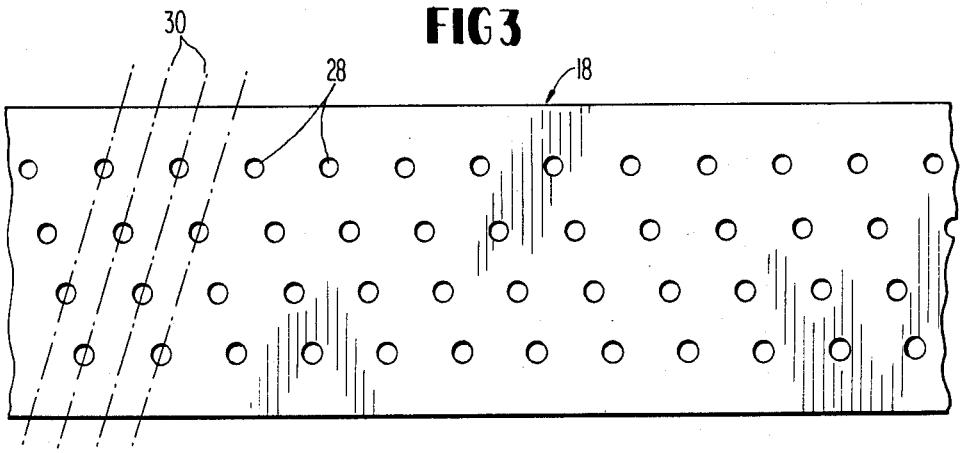
FIG 4
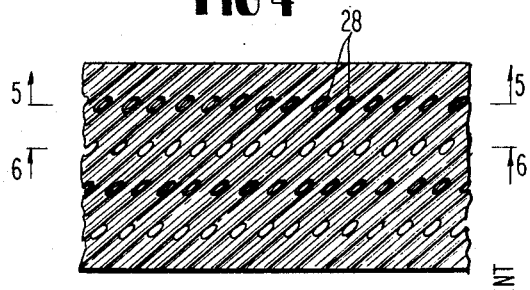
FIG 5
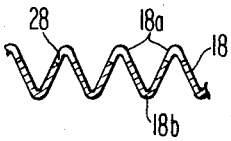
FIG 6
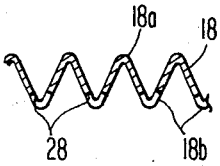
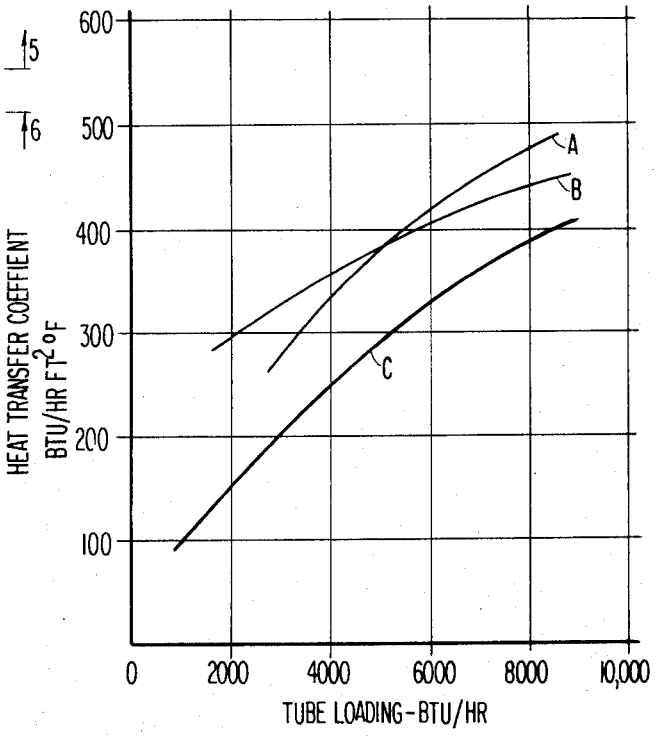
FIG 7

CONCENTRIC TUBE HEAT EXCHANGE ASSEMBLY WITH IMPROVED INTERNAL FIN STRUCTURE

BACKGROUND OF THE INVENTION

This invention relates to heat exchangers, and more particularly to heat exchangers formed by a pair of concentrically spaced tubes defining a substantially annular chamber therebetween and bearing an internal metallic fin in the form of a strip of corrugated sheet metal extending spirally within the annular chamber and bridging the space between the tubes.

Heat exchangers of this type have been employed for some time within the refrigeration field, automotive field and the like for providing a very effective heat exchange between fluids confined within the tubes and fluid externally thereof. One such heat exchanger is shown in U.S. Pat. No. 3,197,975 issued Aug. 3, 1965, to Cecil Boling and assigned to the common assignee. In that patent, a very effective heat exchange unit is formed by a plurality of substantially horizontal tube assemblies each extending generally parallel to each other and formed by a pair of concentrically positioned tubes defining a substantially annular chamber therebetween which is connected at its opposite ends for the flow of the heat exchange fluids therethrough while the other of the heat exchange fluids is carried by the internal of the two concentric tubes. Each of the heat exchange tube assemblies bears an internal metallic fin assembly within the chamber which is formed of a strip of corrugated sheet metal extending spirally within the annular chamber with each of the corrugations being substantially straight and non-distortable and extending longitudinally of the chamber and bridging the space between the tubes and being pressed into contact with respect thereto to thereby divide the annular chamber into a plurality of substantially parallel longitudinal passageways, each extending between the side edges of the strip of corrugated sheet metal. The adjacent turns of the spirally formed strip of corrugated sheet metal are spaced from each other to provide a spiral passageway between the side edges of the adjacent turns to reduce the effective length of each of the longitudinal passageways to that of a single corrugation of the strip and to permit arcuate fluid flow of the heat exchange fluid confined between the tubes, between the serially-related longitudinal passageways along the annular chamber. The distance between the tubes is such that the inner and outer peripheries of the fin assembly have radial compression forces exerted upon them such that the corrugations are placed under radial compression and are subjected to sufficient force to insure a good heat-transfer relationship between each of the tubes in the internal fin assembly.

While this concentric tube heat exchange assembly provides a highly effective and efficient heat exchange between the heat exchange fluid internal of the inner tube and that confined between the tubes or between a fluid confined between the two tubes and a fluid external of the outer tube, it has been determined that the heat transfer coefficient and particularly the boiling heat transfer coefficient can be improved by improving the heat exchanger characteristics of the internal metallic fin of corrugated sheet metal strip.

SUMMARY OF THE INVENTION

The present invention resides in providing a plurality of small apertures within each corrugated sheet metal strip which extends spirally within the annular chamber defined by the concentric metal tubes. Preferably, the apertures are carried by the corrugated strip such that they appear at some point along the corrugations, as at the roots and along the valleys, that is, the areas adjacent the lines of contact between the corrugations and the peripheries of the inner and outer tubes defining the annular chamber.

The apertures may be formed by punching of the metal strips prior to corrugation and prior to forming the spiral. Alternatively, the apertures may be formed during corrugation by first corrugating the sheet metal strip and then cutting or milling slits on opposite sides of the corrugated strip, to a limited depth to form apertures at both the roots and valleys of the corrugations.

BRIEF DESCRIPTION OF THE FIGURES

FIG. 1 is a vertical sectional view of one embodiment of the present invention;

FIG. 2 is a longitudinal sectional view of a portion of the embodiment of FIG. 1;

FIG. 3 is a plan view of a sheet metal strip bearing columns and rows of perforations to define the apertures for the metal strip prior to corrugating of that strip;

FIG. 4 is a plan view of the metal strip of FIG. 3 subsequent to punching and corrugating and prior to a helical placement between the concentric tubes of the embodiments of FIGS. 1 and 2;

FIG. 5 is a sectional view of a portion of the strip of FIG. 4 taken about line 5—5;

FIG. 6 is a sectional view of a portion of the strip of FIG. 4 taken about line 6—6;

FIG. 7 is a graph of the boiling heat transfer coefficient of a standard internal heat exchange assembly of the prior art and several embodiments of the improved heat exchange assembly of the present invention.

DESCRIPTION OF THE PREFERRED EMBODIMENT

Referring to FIGS. 1 and 2 of the drawings, there is shown an improved concentric tube heat exchange assembly indicated generally at 10 and comprised principally of an outer metallic tube 12 of given diameter and an inner metallic tube 14 of somewhat less diameter and forming an annular cavity or space 16 therebetween within which is positioned the third element of the assembly constituted by an internal helical metallic fin 18 comprising a strip of corrugated sheet metal which extends spirally within the annular chamber 16 between tubes 12 and 14. The outer tube may carry a plurality of longitudinally spaced transverse sheet metal fins (not shown) to radiate or absorb heat from surrounding areas or to take up heat and transfer it to further heat exchange fluids which flow through chamber 16, and the internal chamber 20 defined by the internal tube 14. The tubes 12 and 14 may be formed of copper, aluminum or other heat conductive materials while the corrugated sheet metal strip or internal fin 18 should be formed of copper or other highly conductive sheet metal.

The internal helical metallic fin 18 is preformed during manufacture and placed onto the tube 14 or otherwise compressed upon helical wrapping between the tubes 12 and 14 and within the annular chamber 16. In one form of manufacture, the inner tube 14 may be expanded slightly so as to compress the individual corrugations between the outer periphery of the inner tube 14 and the inner periphery of the outer tube 12. The mechanical locking of the helical metallic fins, corrugated sheet metal strip 18 between the concentric tubes, may be achieved by mechanically forcing a mandrel of slightly larger diameter than the internal diameter of the inner tube 14 through the center of that tube to expand the tube slightly and mechanically force the peaks 18*a* and the valleys 18*b* of the individual corrugations of strip 18 into contact with the respective periphery of tubes 12 and 14. The compressive force is sufficient to insure effective heat transfer between each of the tubes and the finned sheet metal strip 18. The finned strip 18 interconnects tubes 12 and 14 by a trough-like portion or longitudinal flow path as at 22 adjacent the inner tube 14 and at 24, adjacent the outer tube 12. Further, in winding the strip 18 in helical fashion about the inner tube 14 in accordance with U.S. Pat. No. 3,197,975, an open spiral is formed leaving a strip of bare tube between adjacent turns of the spiral. Thus, there is defined an open spiral passageway as at 26, FIG. 2, into which the ends of each longitudinal passage or trough 22 and 24 open. Thus, the longitudinal passages 22 and 24 are broken frequently by the spiral passage 26. This insures minimum resistance to flow through chamber 16 and provides the efficient transfer of heat to and from the fluid passing through passsage chamber 16 confined by the inner and outer tubes.

It has been found that assuming that a fluid flows from right to left, FIG. 2, within chamber 16, while there is no stagnant film of fluid on the fin surfaces at the right-hand edges of strip 18, there is however a stagnant film progressively thicker towards reaching a maximum at the left-hand edge of the spiral strip, that is, in a downstream direction, which acts as a heat insulation, causing a resistance to heat transfer and reducing the efficiency of the system. As an advantage to the helical internal fin heat exchanger of U.S. Pat. No. 3,197,975, because the longitudinal dimensions of each of the individual fin surfaces of the corrugated metallic strip 18 is sufficiently small to prevent the formation of a stagnant film sufficient to interfere materially with the proper transfer of heat between the fin portions and the fluid traversing passage 16, it has been found that a more effective heat exchange occurs by in fact reducing surfacewise a portion of the metallic fin strip 18 but improving the nucleat boiling action that takes place with a boiling fluid flowing within the annular chamber 16 between the tubes and a fluid within the flow passages 20 as defined by the inner tube 14, through the use of a plurality of apertures or small diameter openings or holes within the spiral or helical metallic fin corrugated sheet metal strip 18. The presence of the apertures creates localized areas of turbulence within the flow path bearing the fins. The apertures may be formed by punching small diameter holes as at 28 in row and columnar fashion and by subsequently corrugating the strip 18 along corrugation lines as at 30, FIG. 3, to form the corrugated strip structure of FIG. 4. In that respect, and in particular by viewing FIGS. 5 and 6, it may be seen that certain of the apertures 28 appear at the peaks 18*a* while others appear at the valleys 18*b* of the corrugated strip 18.

Obviously, the number and size of the apertures or holes 28, their location and the like, depend on the size of the heat exchanger assemblies such as that shown at 10, the diameter of tubes 12 and 14, and by varying as well the thickness and width of the metallic strip 18 which is corrugated and apertured in the manner of FIGS. 4, 5 and 6. For instance, the diameter of the holes or apertures 28 punched into strip 18 prior to corrugation may be on the order of 0.05 to 0.08 inches in diameter for a representative heat exchanger. Further, in an alternate manner of forming of the helical corrugated sheet metal strip 18, the sheet metal strip after corrugation may be subjected to multiple saw cuts, slits, via a saw, milling tool, etc. on both the top and bottom surfaces, preferably equally spaced with respect to each other and spaced relative to the cuts on the opposite side with the slits being approximately one-half through the fin height. Further, the die producing the corrugations such as intermeshed gear sets could incorporate means to form the slits as apertures as the corrugations are formed. The slits may be 0.01 inch in thickness, 0.02 inches in thickness, etc. Further, while the apertures or holes 28 are illustrated as uniformly formed for respective rows, either within the valleys 18*b* or within the peaks 18*a*, they may in fact occur within the intermediate portions of the corrugation, that is, between the valleys and peaks. Further, the improved structure for the internal fin heat exchanger has definite positive effect where one of the heat exchange fluids is boiling, that is, vaporizing. Also, utilization of the apertures or holes 28 within the fin sheet metal strip 18 effectively improves heat exchange where the fluids do not change state during the heat exchange process by increasing turbulence of the fluids.

By reference to FIG. 7, curves of the boiling heat transfer coefficient for internal fin heat exchange assembly of the type as set forth in U.S. Pat. No. 3,197,975 and that of the present invention are contrasted. The plots of the boiling heat transfer coefficients are made against tube loading, that is, with respect to the amount of heat transferred over a given period of time. Curve C shows the boiling heat transfer coefficient for a prior art internal helical metallic fin corrugated sheet metal strip type heat exchanger in accordance with U.S. Pat. No. 3,197,975. The two curves indicated at A and B, which cross, are representative samples of the improved heat exchange assembly as illustrated in FIGS. 1 and 2 and in accordance with the present invention, the boiling heat transfer coefficient being materially improved relative to that of the so-called standard internal fin heat exchanger as illustrated by curve C. The indicated improvement in the heat transfer characteristics of the heat exchanger materially reduces the amount of heat exchange surface needed and thus the size of the heat exchanger.

It has been determined that the improved heat exchange property of the concentric tube heat exchange assembly employing the perforated or apertured internal fin structure in accordance with the present invention is most evident where one of the heat exchange fluids changes state. For instance, with respect to the test results evidenced in FIG. 7, the slits providing the holes, particularly along the peripheries of the finned sheet metal strip 18 where the corrugations form the fins, result in improved nucleation, that is, the creation of points whereby the gas bubbles may form prior to passing off from the liquid being vaporized. This is particularly so in heat exchanges such as refrigeration or air conditioning evaporators. Further, the heat exchange capability for a given size heat exchanger in accordance with the present invention is improved where the heat exchangers function as condensers. It is also believed that improved circulation of oil carried within the concentric tubes is achieved by the presence of the slit or punch developed apertures or holes with circulation between parallel passages defined by the corrugations of the sheet metal helical strip. As mentioned previously, depending upon the size of the heat exchanger, the width, length, mil thickness, number of holes or apertures and the spacing between the edges of the helical strip to define the spiral or helical flow path for the fluid confined between the concentric tubes which passes between the gaps or spaces 26 through the passages defined by the corrugated helical or spiral strip 18, may readily vary.

While the invention has been particularly shown and described with reference to a preferred embodiment thereof, it will be understood by those skilled in the art that various changes in form and details may be made therein without departing from the spirit and scope of the invention.

What is claimed is:

1. In an evaporative heat exchange unit comprising at least one tube assembly formed by a pair of concentrically positioned tubes defining a substantially annular boiling fluid heat exchange chamber therebetween and which is connected at its ends for the flow of a boiling heat exchange fluid therethrough, an internal metallic fin assembly within said annular chamber comprising a strip of corrugated sheet metal extending spirally within said annular chamber with the corrugations being substantially straight and non-distortable and extending longitudinally of said annular chamber and bridging the space between said tubes to divide said annular chamber into a plurality of substantially parallel longitudinal passages each extending between the side edges of the strip of corrugated sheet metal, the adjacent turns of the spirally formed strip of corrugated sheet metal being spaced from each other to provide a spiral passage between the side edges of the adjacent turns and to thereby reduce the effective length of each of the longitudinal passages to that of a single corrugation of the strip and to permit arcuate fluid flow of the heat exchange fluid between the serially related longitudinal passages along said annular chamber and wherein the distance between the tubes is such that the inner and outer peripheries of the internal metallic fins of the corrugated sheet metal strip have radial compression forces exerted upon them such that the corrugations are placed under radial compression and are subjected to sufficient force to insure a good heat transfer relationship between each of said tubes and said internal metallic fin of corrugated sheet metal strip, the improvement wherein said corrugated sheet metal strip bears a multiplicity of small holes to cause points where localized bubbles of vapor are formed to improve the boiling heat transfer coefficient of the heat exchange unit corrugated sheet metal strip for said boiling fluid flowing between the tubes and passing over the corrugated sheet metal strip surfaces.

2. The heat exchanger as claimed in claim 1, wherein said small holes are in uniform rows and columns.

3. The heat exchanger as claimed in claim 1, wherein said small holes are formed along both the inner and outer peripheries of the corrugated helical wound sheet metal strip to provide openings at the roots and valleys of the fins defined by the corrugations.

4. The heat exchanger as claimed in claim 1, wherein said holes are formed within said corrugated helical wound sheet metal strip such that some of said holes form openings at the roots and valleys of the fins defined by the corrugations.

* * * * *